US006568047B2

(12) United States Patent
Murasaki

(10) Patent No.: US 6,568,047 B2
(45) Date of Patent: May 27, 2003

(54) INTEGRALLY MOLDED SURFACE FASTENER MADE OF SYNTHETIC RESIN

(75) Inventor: Ryuichi Murasaki, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/000,449

(22) Filed: Dec. 4, 2001

(65) Prior Publication Data

US 2002/0069495 A1 Jun. 13, 2002

(30) Foreign Application Priority Data

Dec. 7, 2000 (JP) ..... 2000-373368

(51) Int. Cl.[7] ..... A44B 18/00
(52) U.S. Cl. ..... 24/452; 24/442
(58) Field of Search ..... 24/306, 442, 449, 24/452

(56) References Cited

U.S. PATENT DOCUMENTS 5,537,720 A * 7/1996 Takizawa et al. ..... 24/452
5,692,271 A * 12/1997 Provost et al. ..... 24/452
5,715,581 A * 2/1998 Akeno ..... 24/452
5,781,969 A * 7/1998 Akeno et al. ..... 24/452
5,953,797 A * 9/1999 Provost et al. ..... 24/452

* cited by examiner

*Primary Examiner*—Robert J. Sandy
(74) *Attorney, Agent, or Firm*—Finnegan, Henderson, Farabow, Garrett & Dunner, L.L.P.

(57) ABSTRACT

A molded surface fastener has no stagger between the once engaged engaging elements and has high engagement force so as to strongly prevent the release of the engaging elements, whereby, it is possible to smoothly press and joint the molded surface fasteners made of a synthetic resin each other.

A molded surface fastener made of a synthetic resin has an engaging element and a fitting projection on a surface of a plate-like substrate. The engaging element has a rising portion, which rises from a surface of the plate-like substrate and has an opposite pair of inclined faces, and an engaging head which is continuously formed on a top end of the rising portion and which is expanded at sides of opposite vertical faces in a horizontal direction except for the inclined faces. The fitting projection is positioned between the facing inclined faces of an adjacent pair of engaging elements of a mating surface fastener upon engagement of the engaging elements each other and has inclined faces, which are fit with and abut against both inclined faces, so that it is possible to prevent the stagger upon engagement.

11 Claims, 13 Drawing Sheets

INTEGRALLY MOLDED SURFACE FASTENER MADE OF SYNTHETIC RESIN

BACKGROUND OF THE INVENTION

1. Field of the Invention

The invention relates to a molded surface fastener integrally molded from a thermoplastic synthetic resin. More particularly, the invention relates to a molded surface fastener, which is suitable to a case that engaging elements having substantially same shapes are securely engaged with each other by pressure.

2. Description of the Related Art

Conventionally, a molded surface fastener, which is integrally molded on a-plate-like substrate from a synthetic resin material and enables engaging elements having substantially same shapes to be engaged with each other by pressure, has been used, since the engagement operation of the molded surface fastener is easy, the engaging strength of the molded surface fastener is high, so that the molded surface fastener is particularly suitable for engaging an industrial material and an interior decoration or the like.

For example, a molded surface fastener disclosed in Japanese Patent Application Laid-Open No. 2994464 comprises a mushroom engaging element having a rising portion which rises from a surface of a plate-like substrate and decreases a cross sectional area from a base end to an upper end, and an engaging head, which is located on a top end of this rising portion and is expanded around a circumference of this top end in a horizontal direction. In the molded surface fastener having such a shape, the engaging element works together with an engaging element of a mating surface fastener having the same shape at the time of their engagement, so that part of the head deforms elastically and the engaging element is expanded and contracted in a horizontal direction. Consequently, the engaging element is engaged with the engaging element of the mating surface fastener.

Alternatively, for example, a molded surface fastener disclosed in U.S. Pat. No. 5,212,853 is provided with a gate type engaging element comprising a pair of leg portions rising from a surface of a substrate and an engaging head which couples top ends of these leg portions and is expanded in a horizontal direction orthogonal to an arranging direction of these leg portions. According to such a molded surface fastener, upon engaging, part of the head of the engaging element is elastically deformed as working with an engaging element of a mating surface fastener having the same shape to be enlarged and contracted in a horizontal direction, so that the engaging element is engaged with the engaging element of the mating surface fastener. Further, a columnar projection is protruded on a top portion of the engaging head or a position corresponding to the engaging head of the mating surface fastener on a surface of a substrate. The height of the columnar projection is set so that the columnar projection abuts against a surface of the substrate opposing to the each columnar projection or a top portion of an engaging head. Therefore, it is possible to prevent the stagger in a direction orthogonal to an engaging face between the engaged two surface fasteners.

The molded surface fastener disclosed in the Japanese Patent Application Laid-Open No. 2994464 provides a mushroom engaging element having the engaging head, which is located on the top end of the rising portion and is expanded around the circumference of this top end in a horizontal direction. Further, one engaging element is capable of being engaged with a plurality of engaging elements of the mating surface fastener in all directions of the engaging head, so that a high engagement ratio is secured. However, since a neck portion between the rising portion and the engaging head of the engaging element is narrow, the engaging heads are pulled to opposite directions each other upon releasing the engaging elements of an engagement state, so that the neck portions thereof are apt to be broken off. As such releasing operations are repeated, the engagement force is lowered and an original function as a surface fastener has been lost for a short period of time.

Further, the molded surface fastener disclosed in the in U.S. Pat. No. 5,212,853 provides the gate-type engaging element expanded only in opposite horizontal two directions orthogonal to the arranging direction of the leg portions of the rising portion. Therefore, upon releasing the engaging elements, the heads are not broken off as the mushroom engaging element, so that the engagement force between the rising portion and the engaging head is secured. However, the engaging head is engaged with the adjacent two engaging elements only in the expanding opposite two directions but it is not engaged with the mating fastener in the arranging direction of the leg portions. Therefore, if the engaged surface fasteners are displaced each other in the arranging direction of the leg portions of the engaging element, the engagement force is lowered, so that the surface fastener is easily peeled off.

SUMMARY OF THE INVENTION

This invention has been made to solve the problem mentioned above, and an object of the invention is to provide a molded surface fastener, which has no stagger between the once engaged engaging elements and has high engagement force so as to strongly prevent the release of the engaging elements.

In order to achieve the object, according to the invention, it is provided a molded surface fastener made of a synthetic resin, in which many engaging elements are integrally molded on a surface of a plate-like substrate and which is capable of being engaged with and disengaged from an engaging element of a mating surface fastener having the same shape thereof. Further, it is a character of the molded surface fastener that the engaging element has a rising portion, which rises from a surface of the plate-like substrate and in which a pair of opposite side faces are defined as inclined faces, an engaging head, which is continuously formed on a top end of the rising portion and which is expanded in a horizontal direction at the other opposite side faces except for the inclined faces, and a fitting projection, which is projected from a surface of the plate-like substrate, is positioned between the facing inclined faces of an adjacent pair of engaging elements of a mating surface fastener upon engaging the engaging elements each other and has an inclined face, which is fit with and abuts against at lease one of both inclined faces.

In such a molded surface fastener, the engaging head of the engaging element is expanded in a horizontal direction only at other side faces except for the inclined face of the rising portion. And an expanded side margin is engaged with a side margin of the engaging head of the engaging element of the mating surface fastener at the expanded side margin of the engaging head. By applying such a shape of the engaging element as having the engaging head expanded only at other side faces, it is possible to secure a sufficient engagement force as same as the molded surface fastener disclosed in U.S. Pat. No. 5,212,853.

Alternatively, the molded surface fastener has a fitting projection, which is located between the facing inclined faces of an adjacent pair of engaging elements of the mating surface fastener upon engaging the engaging elements each other and has inclined faces which fit with and abuts against at lease one of both inclined faces of the engaging elements, so that it is possible to effectively prevent the displacement of the engaged surface fasteners in a horizontal direction and the engagement state is certainly maintained. Meanwhile, according to the invention, the fitting and abutting means a case such that the inclined face of the engaging element and the inclined face of the fitting projection are contacted each other and a case such that these inclined faces abut each other with a narrow gap.

Further, according to the molded surface fastener, it is preferable that the fitting projection is located in a position so as to be fit with and abut against both for facing inclined faces of an adjacent pair of engaging elements of the mating surface fastener. Thus, if the fitting projection is fit with and abuts against the both of facing inclined faces of an adjacent pair of engaging elements of the other surface fastener, the displacement between the engaged surface fasteners in a horizontal direction is perfectly prevented.

Further, a pair of the opposite inclined faces of one engaging element are inclined so as to come close each other gradually from a base end to a front end. Thus, if a cross sectional area of the rising portion is progressively increased from the front end to the base end as a joint portion with a surface of a substrate, the strength of the rising portion is increased. Additionally, even in the case that a side face of the engaging head at the expanding side is formed in vertical with respect to a surface of the substrate, because of the existence of the adjacent fitting projection, the surface fasteners are supported by the fitting projection even if they are bent to the vertical face upon pressing the fasteners, so that bending and falling down of the rising portion is restrained and it is possible to secure a required engagement ratio.

Alternatively, a pair of the opposite inclined faces of one engaging element are inclined so as to be substantially in parallel with each other from a base end to a front end. In such an engaging element, particularly, it is preferable that adjacent two engaging elements are shaped in a substantially V with the base ends of their rising portions jointed.

Thus, if the adjacent two engaging elements are jointed at their base ends of the rising portions and part of the rising portion is shared, it is possible to increase the strength of the rising portion. Alternatively, the adjacent two engaging elements are shaped in a substantially V and the engaging heads thereof are bent to the opposite direction so as to be apart each other by the pressure of the surface fasteners upon their engagement, so that it becomes easy to insert the fitting projection between the both engaging elements.

Meanwhile, it is preferable that a shape of the fitting projection is substantially identical with a shape of a space defined between the facing inclined faces of the adjacent pair of engaging elements of the mating surface fastener. For example, it is considered that the fitting projection has a cross section entirely shaped in a substantially trapezoid, or the fitting projection has a cross section entirely shaped in a substantially triangle.

Further, the integrally molded surface fastener has a constitution such that the fitting projection elastically contacts the engaging element firmly. Thus, by elastically contacting the fitting projection and the inclined face of the engaging element, the fitting projection is strongly fit between the engage elements, so that it becomes possible to more effectively prevent the displacement between the engaged two surface fasteners.

As a constitution in order to elastically contact the fitting projection and the inclined face of the engaging element, for example, a constitution such that the fitting projection or the engaging element is manufactured in a hollow shape and in a gate shape and a constitution such that the fitting projection is formed with a pair of elastic projections disposed at a specific distance in the arranging direction of the inclined face are considered.

Further, the projection height of the fitting projection is not more than the height of the engaging element. If the height of a projection in the fitting projection is higher than the height of the engaging element, a gap is generated between a top portion of the engaging element and a surface of the substrate of the mating surface fastener. This state is not desirable. In this case, in order to prevent the stagger in a direction orthogonal to an engagement face, it is further preferable that the height of the projection in the fitting projection is the same as the height of the engaging element.

Furthermore, the fitting projection is formed in the middle of the adjacent two engaging elements. For example, in the case that the inclined faces of the engaging element are arranged in a molding direction, the fitting projection is formed in the middle of the two engaging elements adjacent in a width direction of the resurface fastener. In this case, one engaging element is located between four engaging elements of the mating surface fastener, which are adjacent in a back/forth direction and a right/left direction, and engaged with the four engaging elements.

Alternatively, the fitting projection is formed in the middle of four engaging elements adjacent in a back/forth direction and a right/left direction. In this case, one engaging element is located between two engaging elements adjacent in a width direction of the mating surface fastener and is engaged with an expanded side margins of two engaging elements of the mating surface fastener at the expanded two side margins of the engaging head of this engaging element.

DESCRIPTION OF THE PREFERRED EMBODIMENTS

Figure 1:
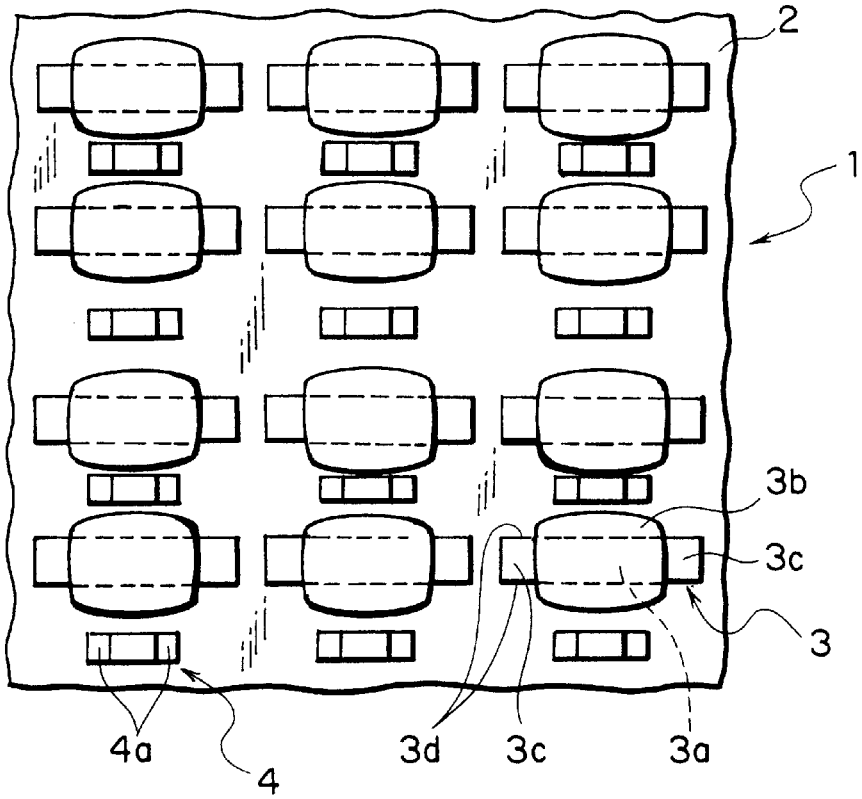
FIG. 1 is an arrangement view of a molded surface fastener according to a first embodiment of the invention.
Figure 2:
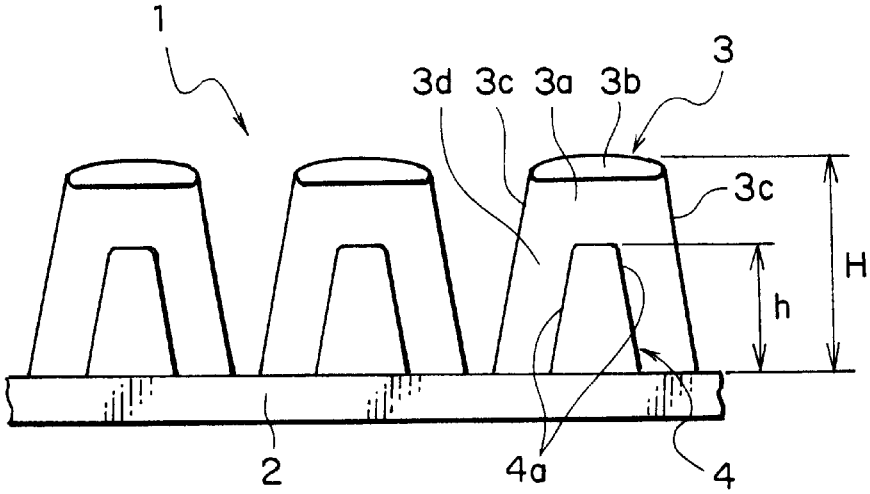
FIG. 2 is a side view of the molded surface fastener of FIG. 1.
Figure 3:
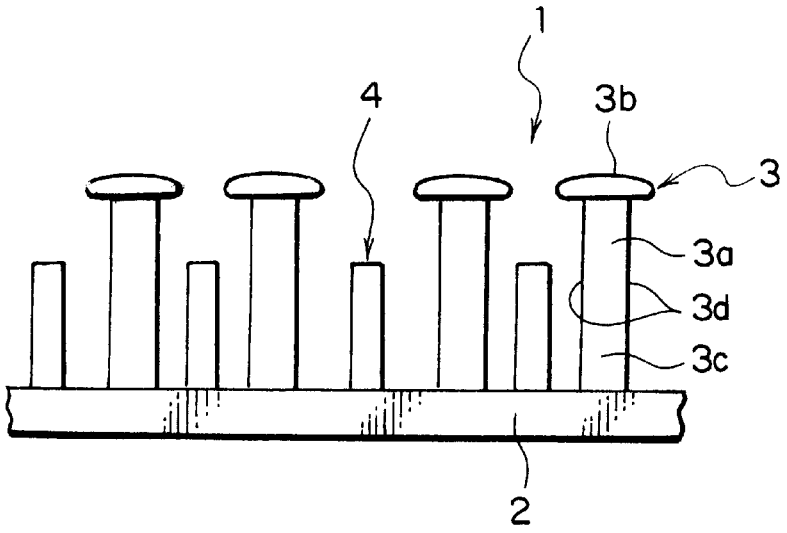
FIG. 3 is a front view of the molded surface fastener of FIG. 1.
Figure 4:
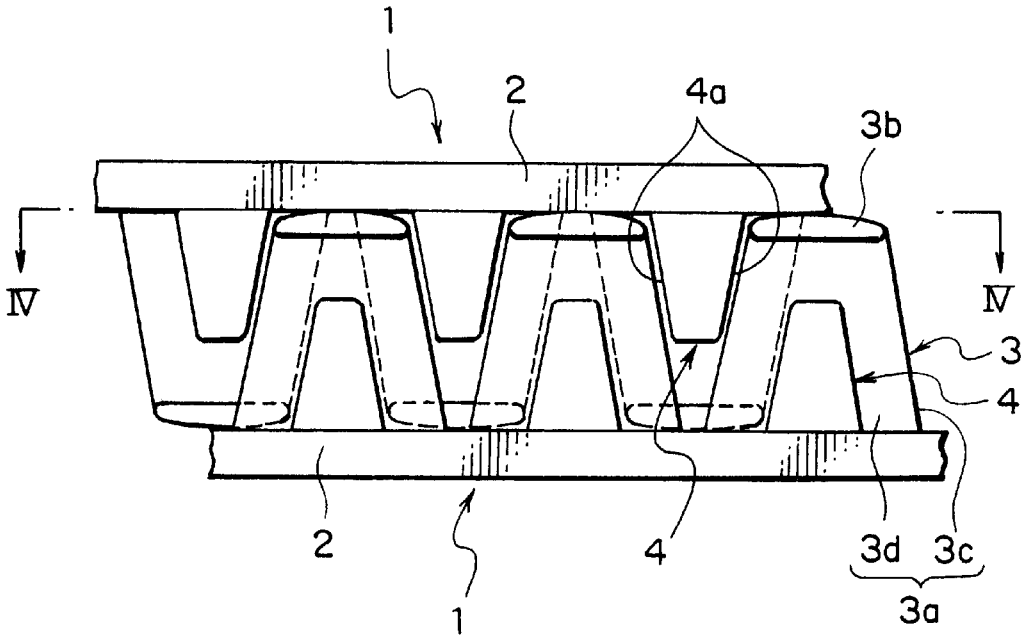
FIG. 4 is a side view showing a state that a molded surface fastener is engaged with a mating molded surface fastener.
Figure 5:
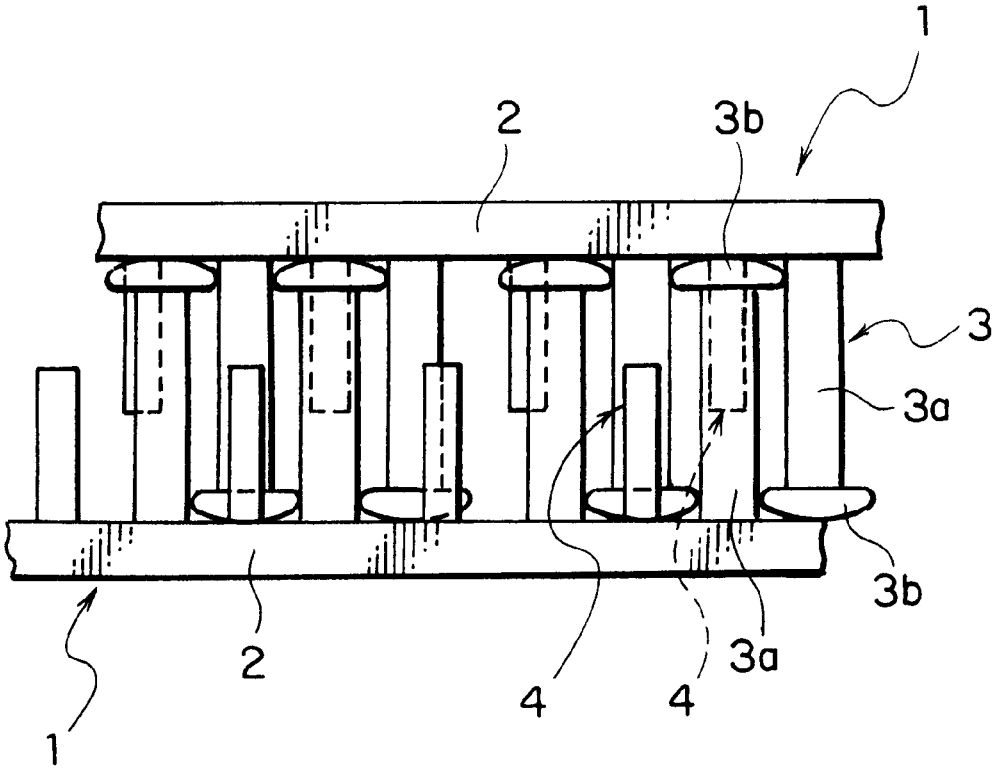
FIG. 5 is a front view showing a state that a molded surface fastener is engaged with a mating molded surface fastener.
Figure 6:
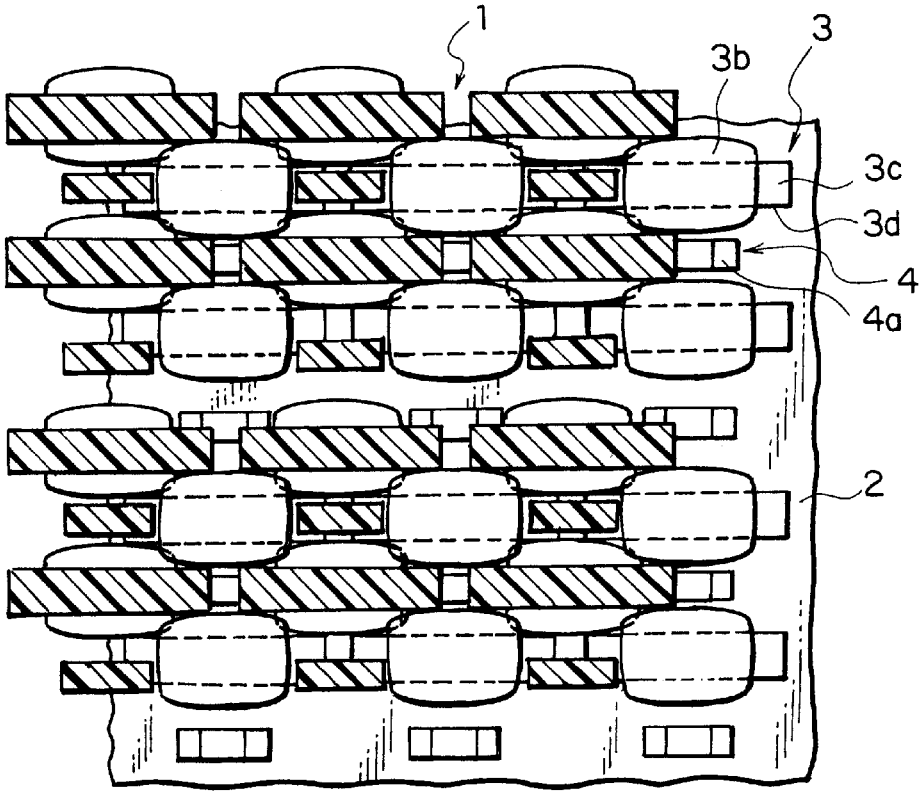
FIG. 6 is a cross sectional view taken along a VIVI line in FIG. 4 for explaining the engagement state of the molded surface fastener with the mating molded surface fastener.

Hereinafter, typical embodiments of the invention will be specifically explained with reference to the drawings. FIG. 1 is an arrangement view of a molded surface fastener according to a first embodiment of the present invention, FIG. 2 is a side view of the molded surface fastener and FIG. 3 is a front view of the molded surface fastener. Further, FIG. 4 is a side view showing a state that a molded surface fastener is engaged with a mating molded surface fastener, FIG. 5 is a front view showing a state that a molded surface fastener is engaged with a mating molded surface fastener and FIG. 6 is a cross sectional view taken along a VI—VI line in FIG. 4 for explaining the engagement state of the molded surface fasteners.

In these drawings, a reference numeral 1 denotes a molded surface fastener. This molded surface fastener is manufactured by using a thermoplastic synthetic resin material. As the thermoplastic synthetic resin material, for example, a polyamide resin, a polyester resin, a polypropylene resin, polyvinyl resin, a polystyrene resin and a polyurethane resin is solely used or a combination thereof is used. Alternatively, in order to secure the simplicity of molding, it is preferable that a molded surface fastener 1 according to the invention is provided with a reasonable shape.

The molded surface fastener 1 is entirely composed of the same kind of synthetic resin material. In this molded surface fastener 1, many engaging elements 3 rise on a surface of a plate-like substrate 2, the engaging elements 3 are arranged in two lines as one block along a molding direction and each block is located at even intervals in a width direction of the fastener. Further, the distance between the lines of one block is set to be smaller than the distance between respective blocks.

Alternatively, the engaging elements 3 adjacent in a molding direction are arranged at an even pitch. Further, fitting projections 4 are formed on the same surface of the substrate 2, in the middle of the adjacent engaging elements 3 of two lines in the same block and in the middle of the two blocks of the adjacent engaging elements 3, respectively.

The constitution of the respective engaging element 3 according to this embodiment is provided with a rising portion 3*a* rising from a surface of the plate-like substrate 2 and an engaging head 3*b* continuously formed on a top end of this rising portion 3*a* as being obvious from FIGS. 1 to 3. The rising portion 3*a* has a rectangular shape of which horizontal cross section is longer in a molding direction, a pair of opposite faces along the molding direction comprise are inclined faces 3*c*, 3*c* and these inclined faces 3*c*, 3*c* are inclined so as to come close each other from their base ends to their upper ends.

Other opposite side faces 3*d*, 3*d* except for the inclined faces 3*c*, 3*c* are vertical faces 3*d*, 3*d* perpendicular to a surface of the plate-like substrate 2. The rising portion 3*a* having these inclined faces 3*c*, 3*c* and vertical faces 3*d*, 3*d* has a vertical section, of which entire shape is a substantially trapezoid.

The engaging head 3*b* is expanded only at sides of the vertical faces 3*d*, 3*d* in a horizontal direction and it is not practically expanded at sides of the inclined faces 3*c*, 3*c*.

Additionally, according to the embodiment, the fitting projections 4 are arranged in the middle of the engaging elements 3 adjacent in a width direction with projecting from a surface of the substrate 2. The fitting projection 4 has a pair of inclined faces 4*a*, 4*a* opposing along a molding direction and an entire shape thereof is a substantially trapezoid. Further, the inclined face 4*a* has the same angle of inclination as that of the inclined face 3*c* of the engaging element 3 and it has a shape so as to be fit in a reverse trapezoid space, which is formed between the engaging elements 3 of the mating surface fastener adjacent in a molding direction.

According to the embodiment, a projection height h of the fitting projection 4 is set to be approximately 0.6 times as the projection height H of the engaging element 3. Alternatively, the projection height h of this fitting projection 4 is capable of being set to be an arbitrary height, if it is not more than the projection height H of the engaging element 3. In order to further prevent the stagger in a direction orthogonal to a surface of the substrate 2 upon engaging the surface fasteners each other, it is preferable that the projection height H of the fitting projection 4 is substantially identical with the projection height H of the engaging element 3.

In the next place, a state such that the molding surface fasteners having the above-mentioned constitutions, according to the first embodiment of the present invention, are pressed and jointed will be explained with reference to FIGS. 4 to 6 below.

When two molded surface fasteners 1 are doubled and pressed from a rear face of the substrate 2, the engaging elements 3 of the opposite molded surface fasteners 1 are inserted each other with elastically deforming the engaging heads 3*b* in a longitudinal direction (a molding direction)

and a width direction of a respective mating surface fastener, namely, to a middle position of four engaging elements 3 adjacent in a back/forth direction and a right/left direction. According to the embodiment, upon this elastic deformation, as the engaging elements 3 are arranged as one block of two lines as described above and further, a distance between each block is set to be larger than a distance between the lines of one block, so that a distance between the engaging element 3 and the fitting projection 4 adjacent to the width direction of the engaging element 3 is larger at one side. Therefore, the engaging element 3 is sufficiently deformed elastically so as to smoothly insert in the engaging element 3 of the mating surface fastener.

Then, after the engaging elements 3 of a surface fastener come over the engaging elements 3 of a mating surface fastener, they elastically get back to the original form. As shown in FIGS. 4 and 5, the top faces of respective engaging heads 3*b* contact a surface of the substrate 2 of the mating surface fastener firmly in this state. Additionally, even if the engaged molded surface fasteners 1 are pulled to such a direction that they are peeled off each other, angular portions of respective engaging heads 3*b* are engaged with four engaging elements 3 of mating surface fastener, which are adjacent in a back/forth direction and a right/left direction. Therefore, the surface fasteners 1 are not easily peeled off and it is possible to obtain a desired engagement force.

In the engagement state of the surface fasteners 1, the fitting projection 4 is positioned between the facing inclined faces 3*c*, 3*c* of a pair of engaging elements 3, 3 of the mating surface fastener adjacent in a molding direction. Further, two inclined faces 4*a*, 4*a* of one fitting projection 4 are fit with and abut against the facing inclined faces 3*c*, 3*c* of the adjacent pair of engaging elements 3, 3.

Thus, in such engaged surface fasteners 1, the fitting projection 4 is fit with a pair of engaging elements 3, 3 adjacent in a molding direction, and the inclined faces 4*a*, 4*a* of one fitting projection 4 is fit with and abuts against both facing inclined faces 3*c*, 3*c* of the one pair of engaging elements 3, 3, so that the engaged surface fasteners 1 do not generate the stagger in a horizontal direction each other and it is possible to maintain the stable engagement state.

Further, the rising portion 3*a* of the engaging element 3 is entirely shaped in a substantially trapezoid. Particularly, this rising portion 3*a* is not easily inclined to the side of its inclined face 3*c*. Alternatively, the fitting projection 4 is formed adjacent to a width direction of the surface fastener orthogonal to a molding direction, so that the inclination to the width direction is restrained and it is possible to secure the stable engagement state.

Meanwhile, according to the embodiment, as shown in FIG. 1, many engaging elements 3 are arranged as one block of two lines with even intervals between each block. However, it is possible to arrange them with even intervals between the lines.

Figure 7:
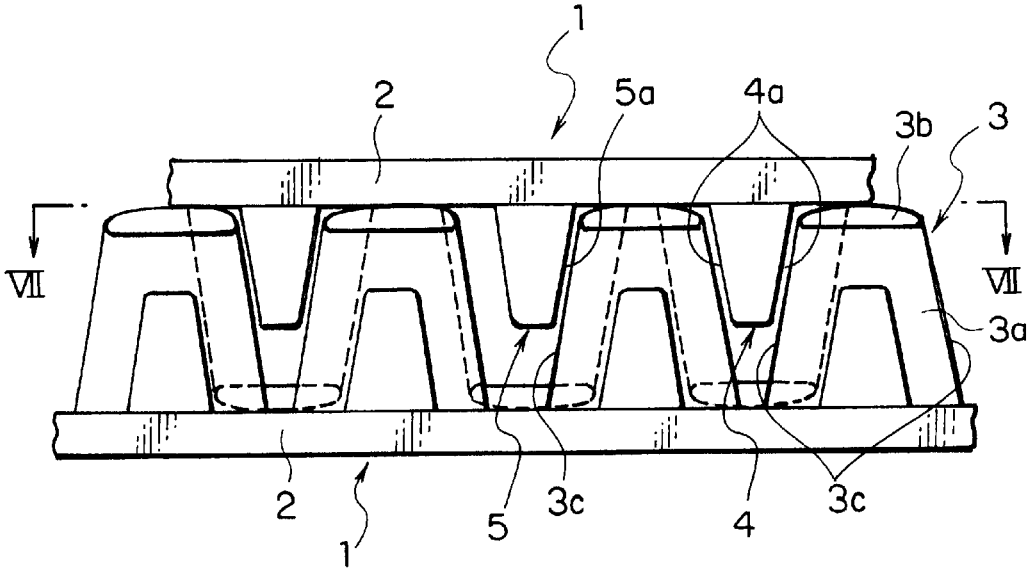
FIG. 7 is a side view showing a state that a molded surface fastener is engaged with a mating molded surface fastener according to a modification of the first embodiment.
Figure 8:
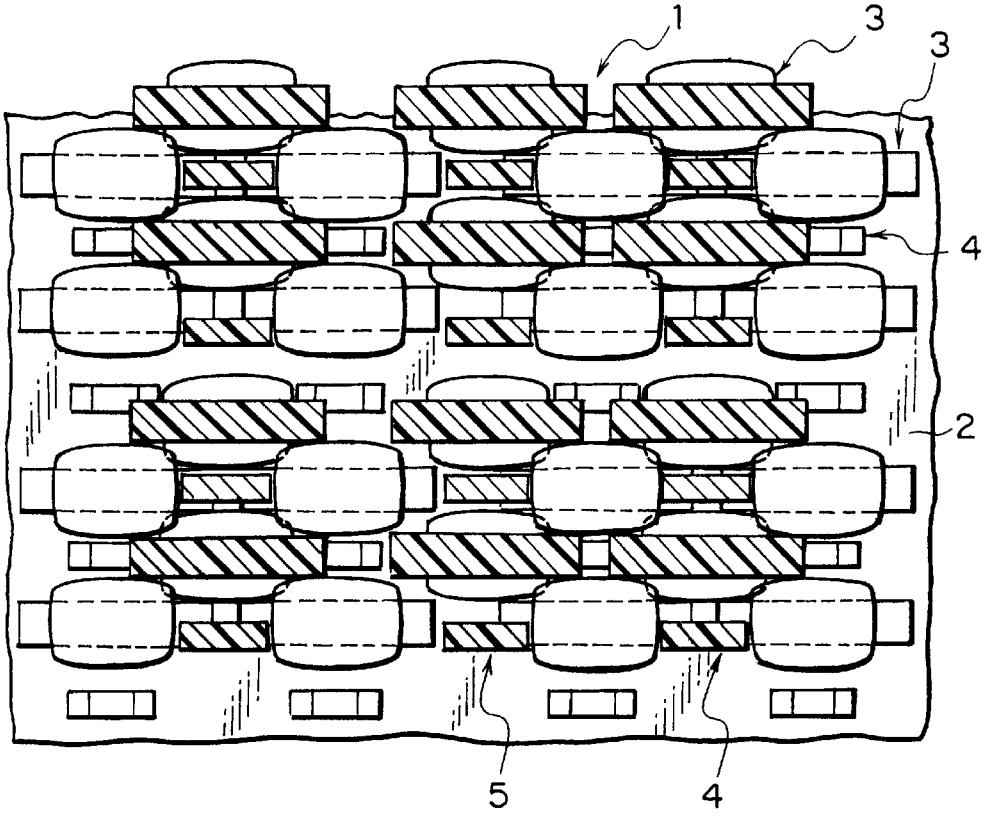
FIG. 8 is a cross sectional view taken along a VI—VI line in FIG. 7 for explaining the engagement state of the molded surface fastener with the mating molded surface fastener shown in FIG. 7.

Additionally, according to the embodiment, all fitting projections 4 are fit with and abut against the facing inclined faces 3*c*, 3*c* of a pair of engaging elements 3, 3 adjacent to the molding direction of the mating surface fastener with even intervals of each engaging element 3 in the molding direction. However, for example, it is also possible to make the intervals of each engaging element 3 in the molding direction uneven. In this case, for example, as shown in FIGS. 7 and 8, in a fitting projection 5 formed at a larger interval portion, the inclined face 5*a* of its one side is only fit with and abuts against the inclined face 3*c* of the engagement projection 3 positioned on the one side. Alternatively, the engaging element 3 arranged at a larger interval portion is engaged with the engaging element 3 of the mating surface fastener only at two angular portions at one side in the molding direction, so that, compared to the above-described embodiment, the engagement force and the peeling resistance become smaller. In this way, if the intervals between the engagement projections 3 in the molding direction are adjusted, it is possible to adjust the engagement force and the peeling force of the surface fastener to a desirable value.

Further, according to the above embodiment, the fitting projection 4 has a substantially trapezoid vertical section entirely. However, this vertical section may be a substantially triangle entirely.

Figure 9:
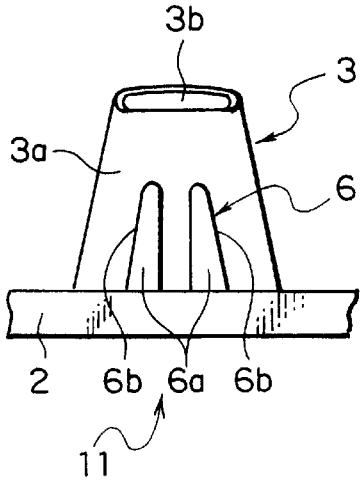
FIG. 9 is a side view of a molded surface fastener according to a second embodiment of the invention.
Figure 10:
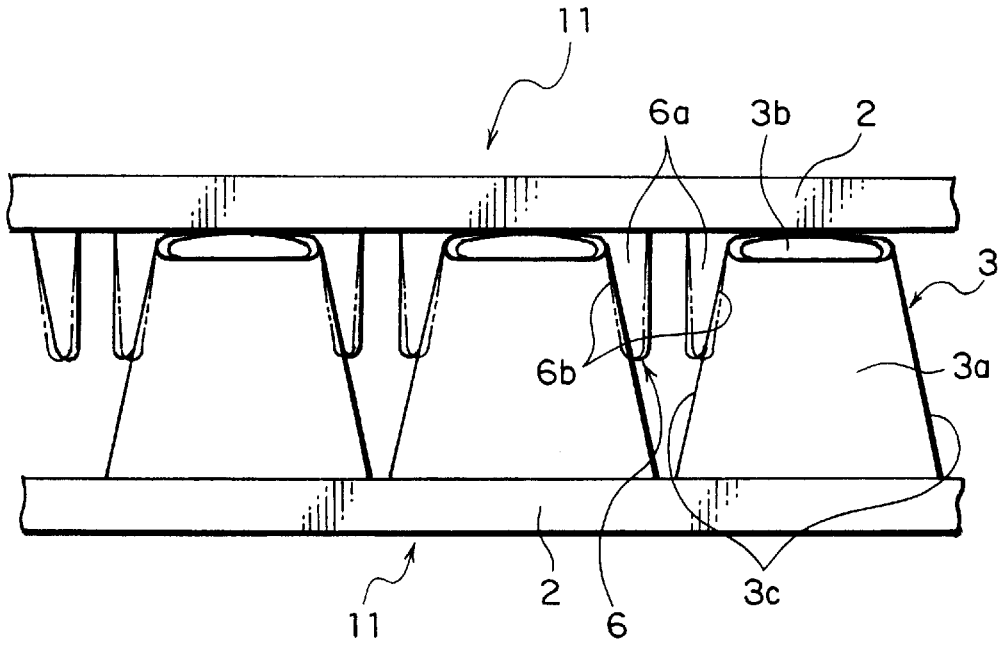
FIG. 10 is a side view for showing an engagement state of the molded surface fastener of FIG. 9.

FIGS. 9 and 10 indicate a molded surface fastener 11 according to a second embodiment of the invention. FIG. 9 is a side view of this molded surface fastener 11 and FIG. 10 is a side view for showing an engagement state of the molded surface fasteners 11. Alternatively, according to this second embodiment, the shape of the engaging elements 3 and their arrangement are the same as those of the first embodiment, so that the detailed explanation thereof is herein omitted.

A constitution of the molded surface fastener 11 according to the embodiment is characterized in a fitting projection 6. The fitting projection 6 according to the embodiment is also formed in a middle position of two engaging elements 3 adjacent in a width direction as same as the first embodiment. This fitting projection 6 comprises a pair of elastic projections 6*a*, 6*a* protruded at specific intervals in a molding direction, and an outside face of the both elastic projections 6*a*, 6*a* in the molding direction is an inclined face 6*b* at a substantially same angle with an inclined face 3*c* of the engaging element 3.

Further, the interval between the outside faces (inclined faces 6*b*, 6*b*) of the elastic projections 6*a*, 6*a* is set to be substantially same as a gap between engaging heads 3*b*, 3*b* of the engaging elements 3, 3 adjacent in the molding direction at its base end portion. Further, the interval between the outside faces of the elastic projections 6*a*, 6*a* is set to be slightly larger than the distance of a corresponding fitting position of the engaging elements 3, 3 at the front end portion. Therefore, as shown in FIG. 10, upon engaging the surface fasteners 11, 11, the inclined faces 6*b*, 6*b* of the elastic projections 6*a*, 6*a* elastically contact both facing inclined faces 3*c*, 3*c* of an adjacent pair of engaging elements 3, 3.

Thus, in the fitting projection 6, its inclined faces 6*b*, 6*b* elastically contact the facing inclined faces 3*c*, 3*c* of an pair of engaging elements 3, 3 firmly, so that it is possible to more effectively prevent the stagger in a horizontal direction upon engagement of the surface fasteners 11, 11.

Figure 11:
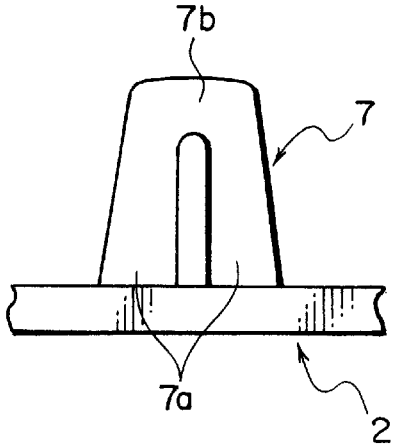
FIG. 11 is a side view showing a modification of a fitting projection.

Meanwhile, according to the invention, a pair of elastic projections 6*a*, 6*a* arranged at specific intervals are employed as the fitting projection 6 so as to make the fitting projection 6 elastically contact the engaging element 3 firmly. However, the embodiment is not limited to such a constitution. For example, as a fitting projection 7 shown in FIG. 11, a constitution of a gate-type fitting projection 7 comprising a pair of leg portions 7*a*, 7*a* arranged in a molding direction, and a coupling portion 7*b* to couple top ends of these leg portions 7*a*, 7*a* may be employed, so that it is possible to make the fitting projection 7 elastically contact the engaging element 3 firmly. Alternatively, it is possible to employ a constitution of a fitting projection, wherein its interior is hollow and side face shape is a substantially trapezoid or triangle.

Figure 12:
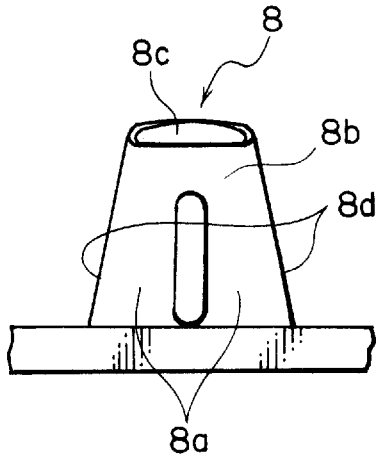
FIG. 12 is a side view showing a modification of an engaging element.

Further, in order to bring the fitting projection contact with the engaging element elastically, as shown in FIG. 12, a rising portion of an engaging element 8 comprises a pair of leg portions 8*a*, 8*a* and a coupling portion 8*b* to couple top ends of the leg portions 8*a*, 8*a*. Further, it is also possible to employ a constitution of a gate-type engaging element such that the top face of the coupling portion 8*b* is an engaging head 8*c*. Also in the case of such a gate-type engaging element 8, the outside faces of the leg portions 8*a*, 8*a* in the molding direction are defined as inclined faces 8*d*, 8*d* and the engaging head 8*c* is expanded at both side faces except for the inclined faces 8*d*, 8*d*. Alternatively, it is also possible to employ the engaging element constitution of which rising portion is in a hollow shape.

Figure 13:
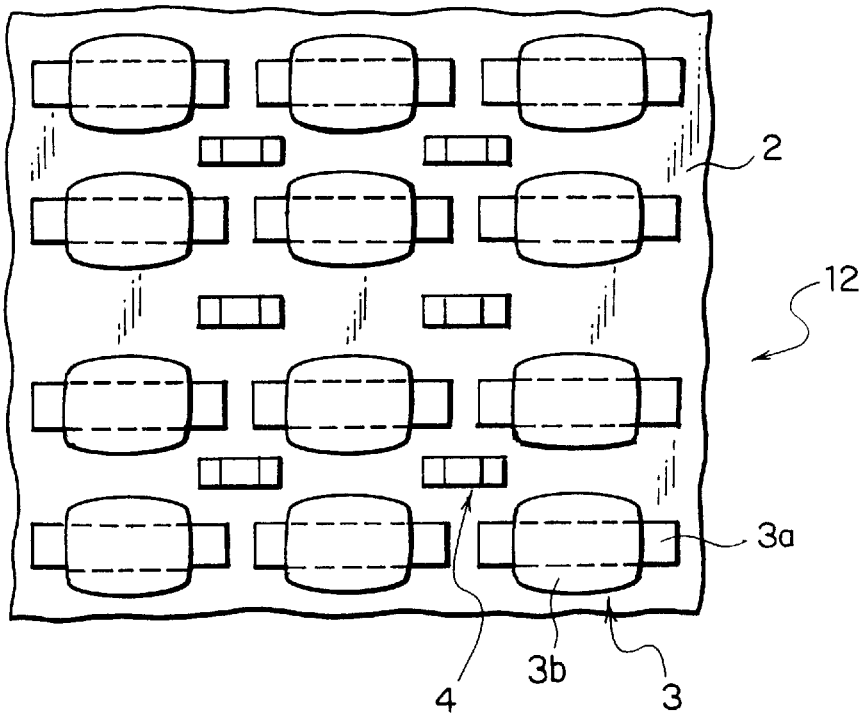
FIG. 13 is a side view of a molded surface fastener according to a third embodiment of the invention.
Figure 14:
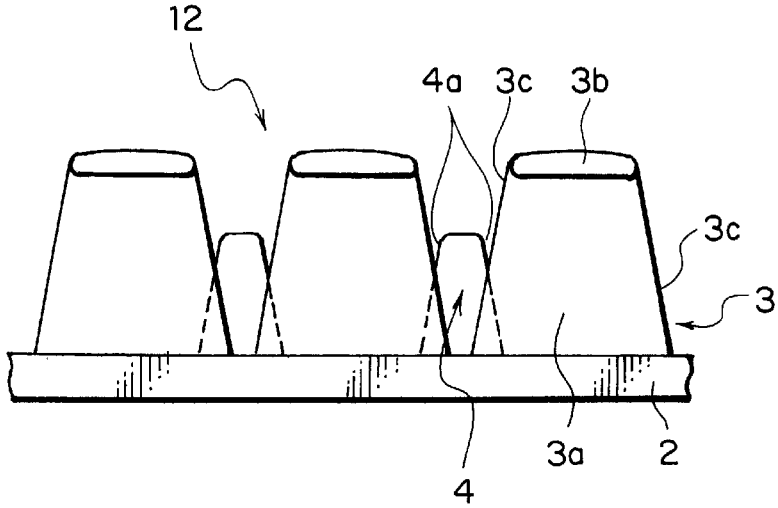
FIG. 14 is a side view of the molded surface fastener of FIG. 13.
Figure 15:
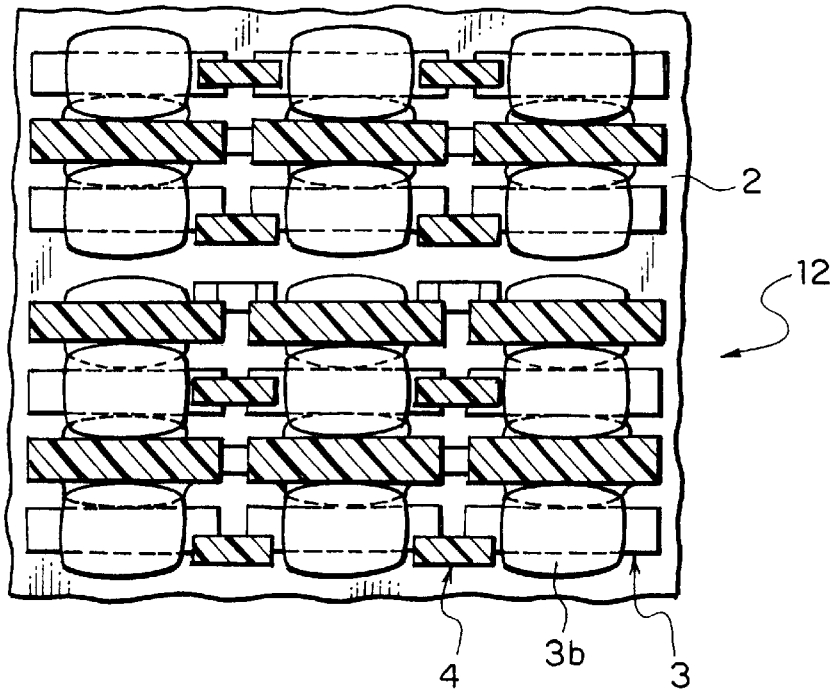
FIG. 15 is an explanatory view showing the engagement state of the molded surface fastener with a mating molded surface fastener.

FIGS. 13 to 15 illustrate a molded surface fastener 12 according to a third embodiment of the invention. FIG. 13 is a arrangement view of this molded surface fastener 12, FIG. 14 is a side view of this molded surface fastener 12 and FIG. 15 is an explanatory view for showing the engagement state of the molded surface fasteners 12. Meanwhile, the molded surface fastener 12 of this third embodiment is characterized in an arrangement of engaging elements 3 and fitting projections 4 and constitutions of the engaging element 3 and the fitting projection 4 are the same as those of the first embodiment, so that the detailed explanation thereof is herein omitted.

According to the molded surface fastener 12 of the third embodiment of the invention, as same as the first and second embodiments, the engaging elements 3 are arranged in two lines as one block and each block is located at even intervals. Further, in the molding direction, the engaging elements 3 are arranged at even intervals. And, a fitting projection 4 projected from the same surface of the substrate 2 is arranged in a middle position of four engaging elements 3 adjacent in the back/forth direction and the right/left direction.

According to the molded surface fastener 12 having such an arrangement, as shown in FIG. 15, upon engaging the surface fastener with a mating surface fastener 12 having the same shape, the engaging elements 3 insert in a middle position of two engaging elements 3 adjacent in a width direction of the mating surface fastener, with elastically deforming an engaging heads 3*b*. Then, if the engaging heads of the engaging elements 3 come over the engaging heads 3*b* of the engaging element 3 of the mating surface fastener, they elastically get back to the original form. Further, two expanded margins of respective engaging heads 3*b* are engaged with the expanded margins of respective engaging heads 3*b* of two engaging elements 3 of the mating-surface-fastener.

In this case, the fitting projection 4 is located between the facing inclined faces 3*c*, 3*c* of a pair of engaging elements 3, 3 of the mating surface fastener adjacent in the molding direction. Further, two inclined faces 4*a*, 4*a* of one fitting projection 4 are fit with and abut against the facing both inclined faces 3*c*, 3*c* of an adjacent pair of engaging elements 3, 3.

Thus, in the engaged surface fasteners 12, the fitting projection 4 is fit with the engaging elements 3 adjacent in the molding direction, and the inclined face 4*a* of the fitting projection 4 is fit with and abuts against the inclined face 3*c* of the engaging element 3, so that the engaged surface fasteners 12 do not generate the stagger in a horizontal direction each other and it is possible to maintain the stable engagement state.

Figure 16:
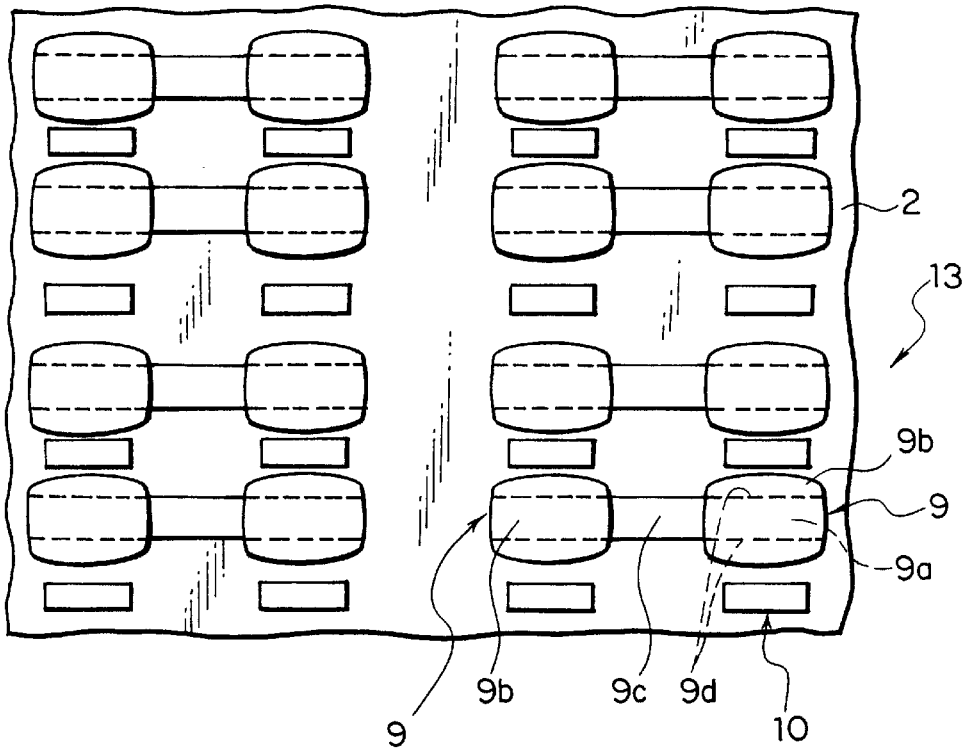
FIG. 16 is an arrangement view of a molded surface fastener according to a fourth embodiment of the invention.
Figure 17:
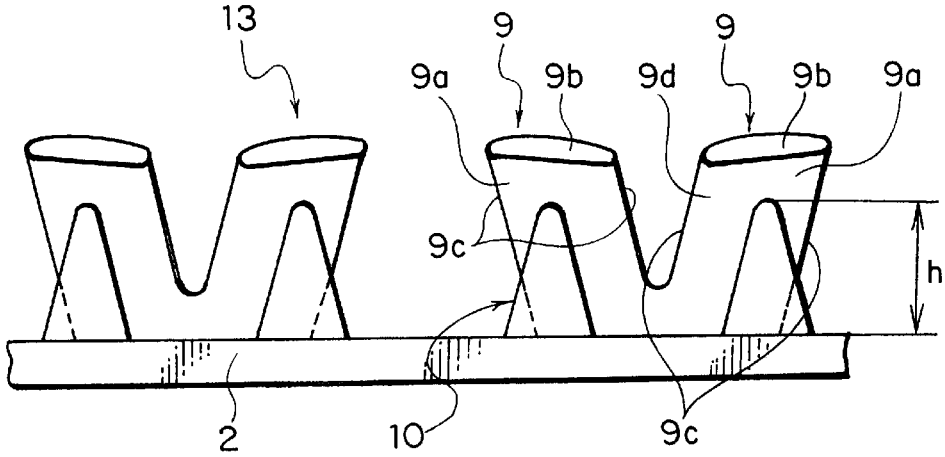
FIG. 17 is a side view of the molded surface fastener of FIG. 16.
Figure 18:
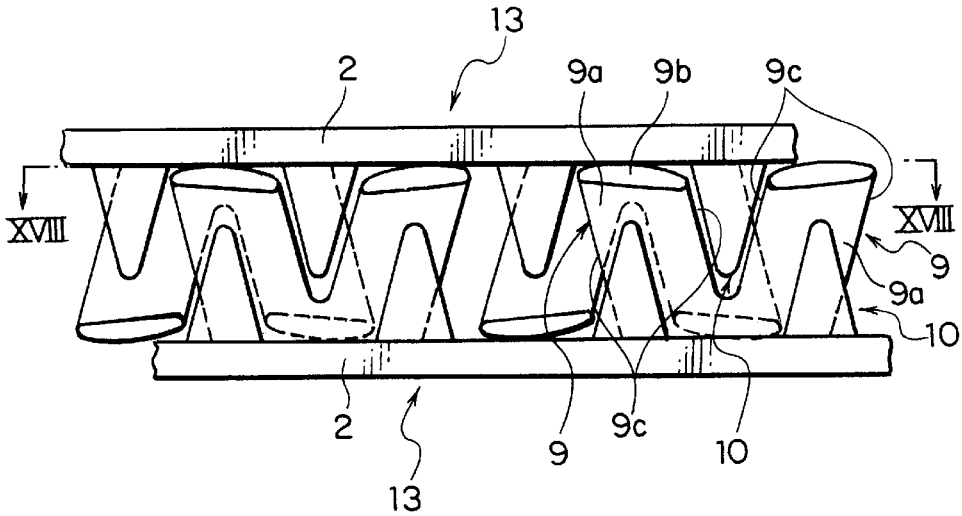
FIG. 18 is a side view showing a state that the molded surface fastener is engaged with a mating molded surface fastener.
Figure 19:
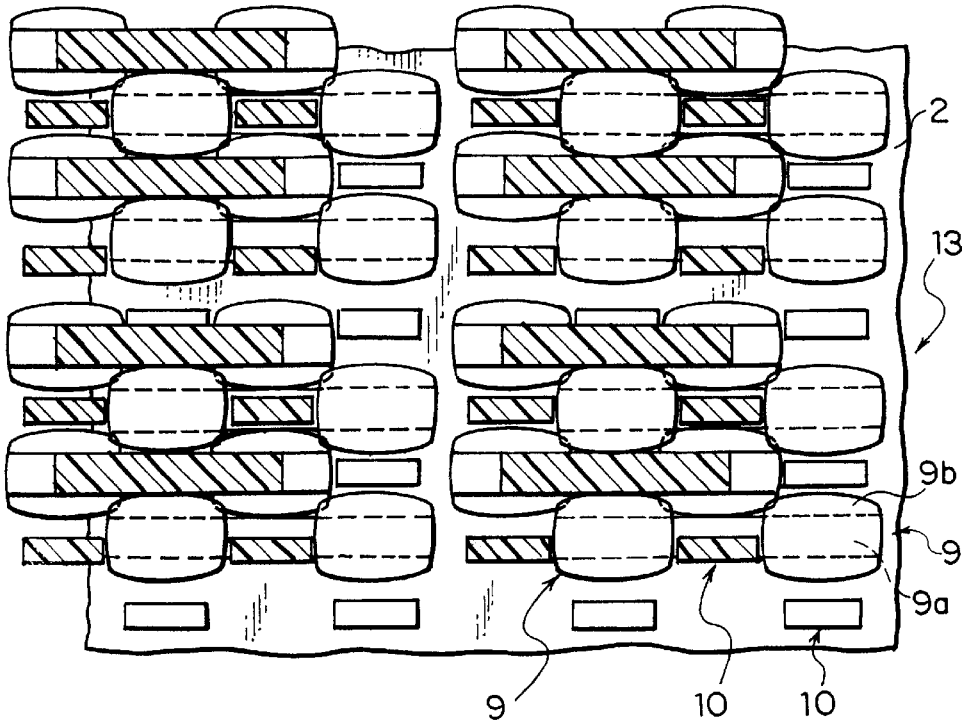
FIG. 19 is a cross sectional view taken along a XIX—XIX line in FIG. 18 explaining the engagement state of FIG. 18.

FIGS. 16 to 19 illustrate a molded surface fastener 13 according to a fourth embodiment of the invention. FIG. 16 is a arrangement view of this molded surface fastener 13, FIG. 17 is a side view of this molded surface fastener 13, FIG. 18 is a side view showing a state that this molded surface fastener 13 is engaged with a mating molded surface fastener, FIG. 19 is a cross sectional view taken along a XIX—XIX line in FIG. 18 for explaining the engagement state.

In this molded surface fastener 13 according to the fourth embodiment, many engaging elements 9 and many fitting projections 10 are projected from a surface of a substrate 2. As being obvious from FIG. 16 and FIG. 17, the engaging element 9 comprises a rising portion 9*a* rising from a surface of the plate-like substrate 2 and an engaging head 9*b* continuously formed on a top end of this rising portion 9*a*.

In the rising portion 9*a*, a pair of side faces at the opposite sides along the molding direction are defined as inclined faces 9*c*, 9*c* and these inclined faces 9*c* are inclined in parallel with each other from their base ends to their upper ends. Further, in two engaging elements 9, 9 adjacent in a molding direction, base ends of each other's rising portions 9*a*, 9*a* are partially jointed and each other's inclined faces 9*c*, 9*c* are inclined in a direction in reverse with respect to the molding direction. These two facing inclined faces 9*c*, 9*c* form a substantially V. Alternatively, the engaging head 9*b* is expanded only at the sides of opposite vertical faces 9*d*, 9*d* except for a pair of the inclined faces 9*c*, 9*c* in a substantially horizontal direction.

The fitting projection 10 is positioned in the middle of the engaging elements 9, 9 adjacent in a width direction and the fitting projection 10 having a pair of inclined faces 10*a*, 10*a* opposed along the molding direction is entirely formed in a substantially triangle. Further, the inclined face 10*a* has the same inclined angle as that of the inclined face 9*c* of the engaging element 9 and a height h of the fitting projection 10 is set to be substantially same as a height from a branch in a V shape of two engaging elements 9 adjacent in the molding direction to the engaging head 9*b*. In other words, the fitting projection 10 takes a shape so as to be fit with a space in an inverted triangle formed between two adjacent engaging elements 9 sharing a base end.

If two pieces of molded surface fasteners 13 according to the forth embodiment having such a constitution are engaged with each other, as shown in FIGS. 18 and 19, respective engaging elements 9 insert in a middle position of four engaging elements 9 adjacent in a back/forth direction and a right/left direction of the mating surface fastener, with elastically deforming the engaging head 9*b*. Then, if the engaging head 9*b* of the engaging element 9 of one surface fastener comes over the engaging head 9*b* of the engaging element 9 of the mating surface fastener, it elastically gets back to the original form. Further, four angular portions of respective engaging heads 9*b* are engaged with the angular portions of respective engaging heads 9*b* of four engaging elements 9 of the mating surface fastener.

The fitting projections 10 are inserted between a pair of engaging elements 9, 9 adjacent in the molding direction of the mating surface fastener and shares a base end. In this case, as described above, since a pair of engaging elements 9, 9 sharing a base end are shaped in a substantially V, upon engagement, the engaging heads 9*b*, 9*b* are apt to be bent in the directions making each other apart by the pressure of the surface fasteners, so that the fitting projections 10, 10 are easily inserted between the both of engaging elements 9, 9.

The fitting projections 10 inserted between the engaging elements 9, 9 are positioned between the facing inclined faces 9*c*, 9*c* of the engaging elements 9, 9 and two inclined faces 10*a*,10*a* of one fitting projection 10 are fit with and abut against the facing inclined faces 9*c*, 9*c* of an adjacent pair of engaging elements 9, 9. Alternatively, according to the embodiment, the fitting projections 10, 10 arranged in the molding direction are fit with the inclined faces 9*c*, 9*c* of the engaging elements 9, 9 of the mating surface fastener alternately so as to be fit with and abut against the both inclined faces 9*c*, 9*c*.

In the surface fastener 13 engaged in such a way, the fitting projection 10 is fit between the facing inclined faces 9*c*, 9*c* of the engaging elements 9, 9 adjacent in the molding direction, and the inclined faces 10*a*, 10*a* of the fitting projection 10 are fit with and abut against the both inclined faces 9*c*, 9*c* of the engaging elements 9, 9, so that the engaged surface fasteners 13 do not generate the stagger in a horizontal direction each other and it is possible to maintain the stable engagement state.

Figure 20:
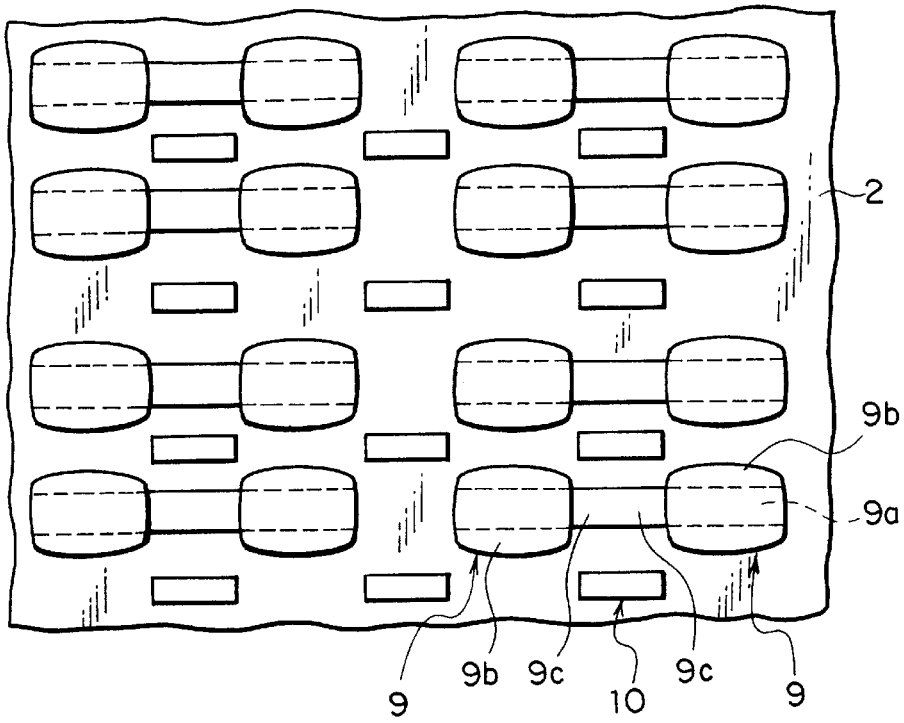
FIG. 20 is an arrangement view of a molded surface fastener according to a modification of the fourth embodiment of the invention.

Alternatively, in the engaging element 9 and the fitting projection 10 having the above-mentioned constitutions, as shown in FIG. 20, it is possible to employ an arrangement so as to form the fitting projection 10 in a middle position of four engaging elements 9 adjacent in the back/forth direction and the right/left direction. In the case of such an arrangement, the engaging elements 9 in the engagement state are located between the two engaging elements adjacent of the mating surface fastener in a width direction. Additionally, in one engaging element 9, two side margins of the engaging head 9*b* are engaged with the side margins of two engaging elements 9 adjacent in a width direction of the mating surface fastener.

A preferable manufacturing method of the molded surface fastener described above will be specifically explained below. In the following explanation, a manufacturing method of the molded surface fastener according to the first embodiment is taken as an example, however, the molded surface fasteners according to the second thorough fourth embodiments are capable of being manufactures in the same way.

Figure 21:
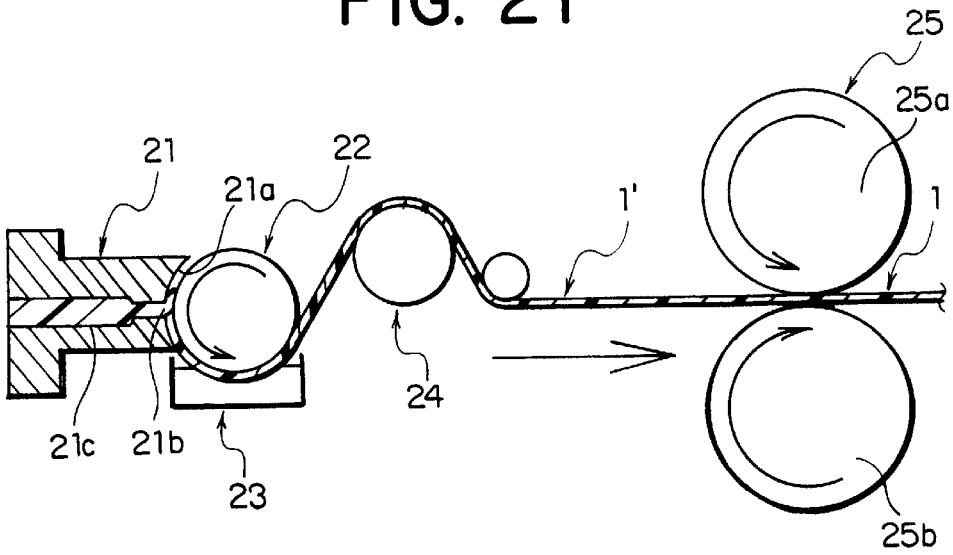
FIG. 21 is a general view illustrating a schematic constitutional example of a manufacturing apparatus to be preferably used for manufacturing the above-mentioned molded surface fastener.
Figure 22:
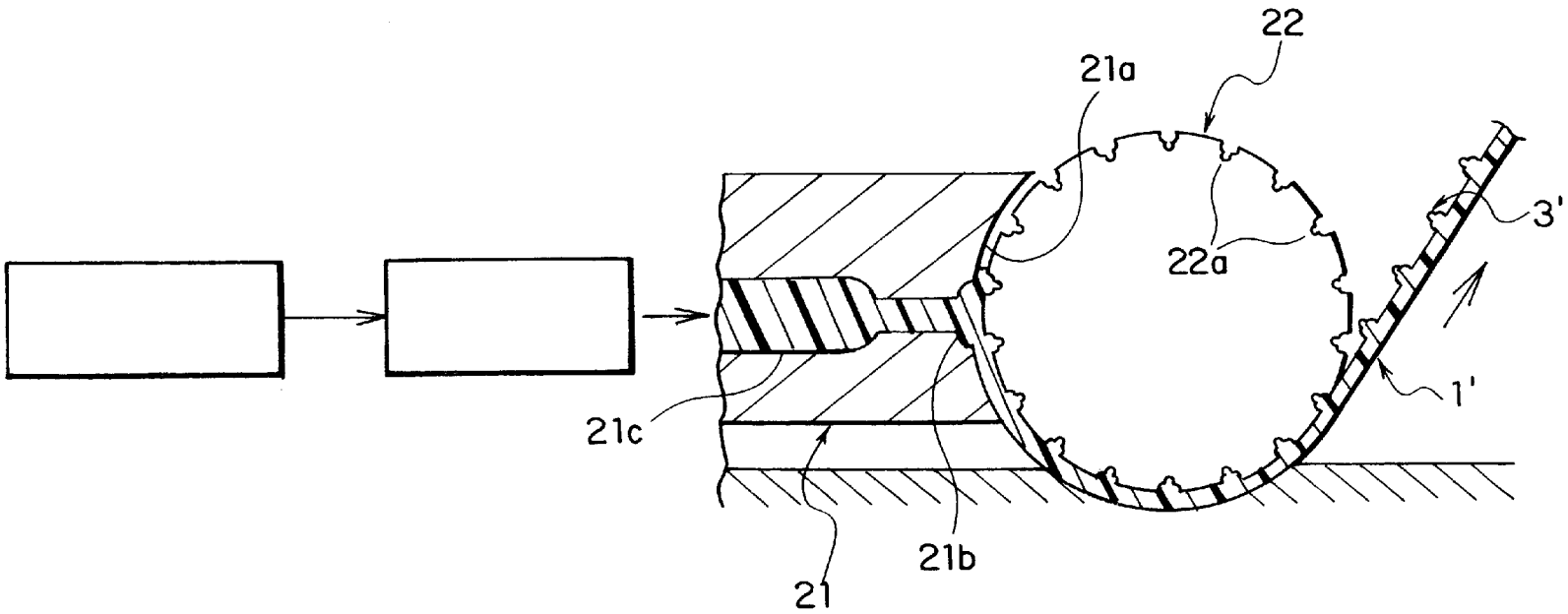
FIG. 22 is an explanatory view of a molding portion in the manufacturing apparatus of FIG. 21.

FIG. 21 is a whole view for illustrating one example of a schematic constitution of a manufacturing apparatus used for molding the molded surface fastener 1 continuously and FIG. 22 is an enlarged view of its molding portion.

In these drawings, a reference numeral 21 denotes an extruding nozzle and a curved surface of a front end of this nozzle 21 has an arc surface 21*a* having a substantially same curvature as that of a die wheel 22 to be described later. Further, this extruding nozzle 21 is provided with forming a gap corresponding to a wall thickness of the plate-like substrate 2 to be molded on the curved surface of the die wheel 22. From a resin extruding outlet 21*b* formed on a center portion of the front end arc surface 21*a* of this extruding nozzle 21, a melted resin is continuously extruded in a form of a sheet with a specific resin pressure and a specific amount of a resin. According to the embodiment, the extruding nozzle 21 has one melted resin passage 21*c* in a center thereof.

The die wheel 22 is shaped in a hollow drum having a water cooling jacket as an inner cooling means. Further, its peripheral surface has a function as a partial molded surface of the molded surface fastener 1. As described above, said gap is provided with respect to the front end arc surface 21*a* of the extruding nozzle 21 as well as an axis of the die wheel 22 is set in parallel with the extruding outlet 21*b*.

According to the embodiment, on the peripheral surface of the die wheel 22, many cavities for molding the engaging element and many cavities for molding the fitting projection are formed in the arrangement of the above-described molded surface fastener. The die wheel 22 having such a constitution is rotatably driven in a direction shown with an arrow in FIG. 21 by a well known driving apparatus (not illustrated).

Figure 23A:
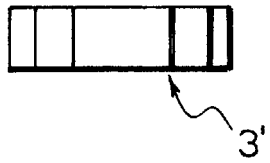
FIGS. 23A and 23B show a top view and a side view of an element of a one-dimensional fastener having a one-dimensional form constituting a material of the molded surface fastener according to the first embodiment.
Figure 23B:
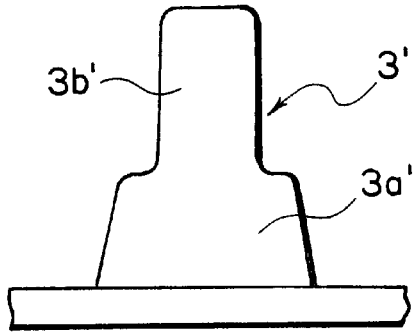

An inner shape of the cavity for molding the fitting projection is substantially same as the outer shape of the fitting projection 4. Further, as shown in FIG. 23(*a*), its top face has an inner shape substantially same as the outer shape of the element 3', namely, a rectangular shape which is longer in a molding direction. Alternately, a cavity for molding an engaging element 22*b* has the outer shape of an element 3' shown in FIG. 23, namely, as shown in FIG. 23(*b*), its side shape is a shape such that a rectangular portion 3*b*' is protruded on a top face of a trapezoid portion 3*a'*.

Figure 24:
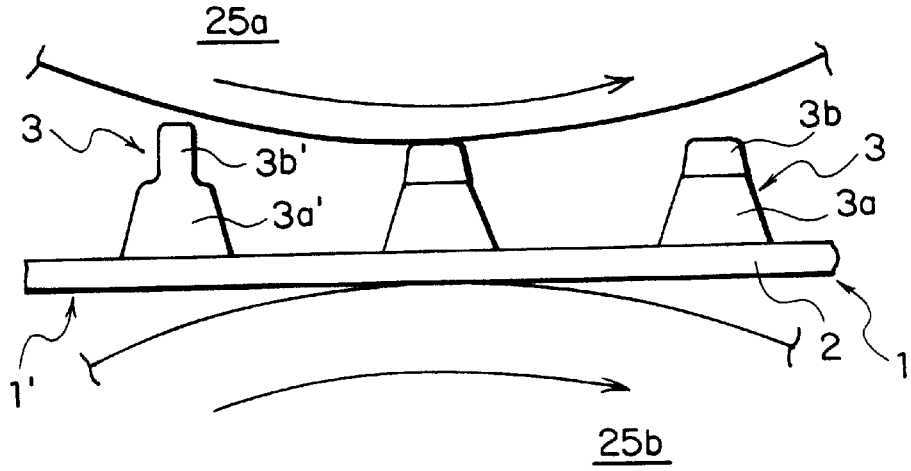
FIG. 24 is an explanatory view of processing of the engaging head by heating and compressing means according to the manufacturing apparatus.

Alternatively, according to the embodiment, a cooling water tank 23 is located below the die wheel 22 and a substantially lower half portion of the die wheel 22 is soaked in the interior of the cooling water tank 23. At the upper and oblique direction of the front of this cooling water tank 23, a taking up roll 24 is located. Simultaneously, further front of this rewinding roll 24, a pair of upper and lower rolls 25*a* and 25*b* constituting heading and pressing means 25 shown in FIG. 24, are located.

The upper roll 25*a* has a heating source (not illustrated) in the interior thereof and a temperature of a surface thereof is set to a temperature such that a used resin material gets soft. Alternatively, as shown in FIG. 24 with enlarged, a lower end of the peripheral surface of this upper roll 25*a* is located slightly lower than a plane on which a top portion of the element 3' of a one-dimensional fastener is conveyed and it is set to have a height of the engaging head 3*b* of the molded engaging element 3. Alternately, a top face of the lower roll 25*b* located such as facing to and below the upper roll 25*a* is set to be located on a plane on which a lower face of a plate-like substrate of the one dimensional fastener is moved.

In order to manufacture the surface fastener 1 of the invention by a molded surface fastener manufacturing apparatus having the above constitutions, the melted resin continuously extruded from the extruding nozzle 21 with a specific resin pressure is continuously introduced in a gap formed with respect to the rotating die wheel 22 and part of the melted resin is filled in the gap to mold the plate-like substrate 2. Simultaneously, part of the melted resin is sequentially filled in the cavity for molding the engaging element 22*a* formed on the peripheral surface of the die wheel 22, and the cavity for molding the fitting projection so as to continuously mold a one dimensional molded surface fastener 1' such that many elements 3' and many fitting projections 4 are integrally molded on a surface of the substrate 2 in accordance with the rotation of the die wheel 22.

The one-dimensional molded surface fastener 1' having a one-dimensional shape comprising a raw material of the surface fastener 1 according to the invention on the peripheral surface of the die wheel 22 goes around a substantially half peripheral surface of the die wheel 22. During this period, the one-dimensional molded surface fastener 1' is positively cooled by a cooling water jacket from the interior of the die wheel 22, and at the same time, the one-dimensional molded surface fastener 1' is conveyed thorough the interior of the cooling water tank 23, in which the low-temperature cooling water is circulating, to be rapidly cooled, so that the one-dimensional molded surface fastener 1' is facilitated to be solid.

The substrate 2, which is completely solid, is rewound by the rewinding roller 24. The molded one-dimensional surface fastener 1' is conveyed between the upper and lower rolls 25*a* and 25*b*, which are heating and compressing means 25. When it is conveyed between these rollers 25*a* and 25*b*, as shown in FIG. 24, in the element 3', a top of a rectangular portion 3*b*' projecting on a top face of a trapezoid portion 3*a*' is pressed by the upper heating roll 25*a* as well as heated, so that this rectangular portion 3*b*' is deformed from its top as being melted and the top face thereof becomes a substantially flat face. At the same time, an engaging head 3*b* enlarged in a width direction of the molded surface fastener is formed, so that a shape of the engaging element 3 according to the invention can be obtained.

After removing the coolness under the ordinary temperature without using particular cooling means, the molded surface fastener 1 according to the invention conveyed through the upper and lower rollers 25*a*, 25*b* is rewound to be completely manufactured.

According to the manufacturing method for using the described manufacturing apparatus, it is possible to manufacture a molded surface fastener of the invention continuously. It is a matter of course that the molded surface fastener of the invention may be manufactured continuously by using an appropriate apparatus other than the above-described apparatus, or, it may be molded by a batch process using a normal injection molding apparatus.

What is claimed is:

1. An integrally molded surface fastener made of a synthetic resin, in which many engaging elements are integrally molded on a surface of a plate-like substrate and which is capable of being engaged with and disengaged from an engaging element of a mating surface-fastener having the same shape thereof;

wherein each engaging element has a rising portion, which rises from a surface of said plate-like substrate and in which a pair of opposite side faces are defined as inclined faces, and an engaging head, which is continuously formed on a top end of said rising portion and which is expanded in a horizontal direction at the other opposite side faces except for said inclined faces; and said molded surface fastener has a fitting projection projected from a surface of said plate-like substrate and positioned between the facing inclined faces of an adjacent pair of engaging elements of the mating surface fastener upon engagement of said engaging elements with each other, and has inclined faces, wherein the fitting projection is fit with and abuts against at least one of both of the facing inclined faces.

2. An integrally molded surface fastener according to claim 1, wherein said fitting projection is located in a position so as to be fit with and abut against both facing inclined faces of an adjacent pair of engaging elements of the mating surface fastener.

3. An integrally molded surface fastener according to claim 1, wherein a pair of said opposite inclined faces of one engaging element are inclined so as to come close to each other from a base end to a front end.

4. An integrally molded surface fastener according to claim 1, wherein a pair of said opposite inclined faces of one engaging element are inclined so as to be substantially in parallel with each other from a base end to a front end.

5. An integrally molded surface fastener according to claim 4, wherein adjacent two engaging elements form a substantially V shape as the base ends of their rising portions are jointed.

6. An integrally molded surface fastener according to claim 1, wherein said fitting projection has a cross section entirely shaped in a substantially trapezoid.

7. An integrally molded surface fastener according to claim 1, wherein said fitting projection has a cross section entirely shaped in a substantially triangle.

8. An integrally molded surface fastener according to claim 1, wherein said integrally molded surface fastener has a constitution such that said fitting projection elastically and firmly contacts said engaging element.

9. An integrally molded surface fastener according to claim 1, wherein the projection height of said fitting projection is not more than the height of said engaging element.

10. An integrally molded surface fastener according to claim 1, wherein said fitting projection is formed in the middle of the adjacent two engaging elements.

11. An integrally molded surface fastener according to claim 1, wherein said fitting projection is formed in the middle of four engaging elements adjacent in a back/forth direction and a right/left direction.

* * * * *